US005290587A

United States Patent [19]

Young et al.

[11] Patent Number: 5,290,587

[45] Date of Patent: Mar. 1, 1994

[54] METHOD OF MAKING AN ELECTROPHORETIC CAPILLARY TUBE

[75] Inventors: James E. Young, La Honda; Mark Bateman, Mt. View, both of Calif.; Jurgen A. Lux, Niederkirchen, Fed. Rep. of Germany

[73] Assignee: Hewlett-Packard Company, Palo Alto, Calif.

[21] Appl. No.: 914,153

[22] Filed: Jul. 14, 1992

[51] Int. Cl.[5] ..... C23C 4/00; B05D 1/00

[52] U.S. Cl. ..... 427/122; 427/372.2; 427/389.7; 427/407.2; 427/424; 427/425

[58] Field of Search ..... 427/122, 407.2, 372.2, 427/389.7, 424, 425

[56] References Cited

U.S. PATENT DOCUMENTS

| | | | |
|---|---|---|---|
| 3,563,916 | 2/1971 | Takashima | 427/122 |
| 4,146,454 | 3/1979 | Haber | 204/180.1 |
| 4,534,998 | 8/1985 | Du Pont | 427/122 |
| 4,705,616 | 11/1987 | Andresen et al. | 204/299 R |
| 4,842,701 | 6/1989 | Smith et al. | 204/180.1 |
| 4,868,008 | 9/1989 | Marikar | 427/126.1 |
| 4,936,974 | 6/1990 | Rose et al. | 204/299 R |
| 4,940,883 | 7/1990 | Karger et al. | 219/200 |
| 5,180,475 | 1/1993 | Young | 204/180.1 |

FOREIGN PATENT DOCUMENTS

| | | |
|---|---|---|
| 55-40048 | 10/1981 | Japan . |
| 1312907 | 7/1991 | Japan . |

*Primary Examiner*—Shrive Beck
*Assistant Examiner*—Vi D. Dang

[57] ABSTRACT

A method of making a capillary tube for providing increased control of electroosmotic flow in electrophoretic separation. A resistive coating solution is formed so that a tube coating having a high electrical resistivity may be achieved. An electrically conductive material, such as carbon black, is homogeneously mixed with a polymer, such as polyimide, in a solvent. The content by weight of the electrically conductive material is less than 20 percent and is preferably within 7 percent to 8 percent, relative to the content by weight of the polymer. The resistive coating solution is applied to the exterior of the tube until a thickness is reached which achieves a desired resistance across the coated exterior surface. Typically, a multi-layered coating is formed. The coating solution may be applied while rotating the capillary tube or, alternatively, while the capillary tube is drawn past an applicator.

18 Claims, 5 Drawing Sheets

METHOD OF MAKING AN ELECTROPHORETIC CAPILLARY TUBE

DESCRIPTION

1. Technical Field

The present invention relates generally to electrophoretic systems and more particularly to methods of making capillary tubes that permit control of electroosmotic flow.

2. Background Art

Applications for electrophoresis, an analytical technique for separating and identifying constituents in a sample, include the determination of a sample's purity, the determination of molecular weights for proteins and nucleic acids, the mapping of nucleic acid primary structures, i.e. DNA and RNA sequence analyses, and the definition of phenotypic variance of a protein at the molecular level. Electrophoretic techniques rely on the fact that each molecular species has a unique combination of mass, size, shape, charge, density and sub-unit structure, all of which result in mobility differences responsive to an electrical field. Various electrophoretic techniques use one or more of these properties to cause varying degrees of molecular separation via the migration of molecular species under an electrical field.

Capillary electrophoresis is a technique using a capillary tube which is filled with a conductive fluid, as for example a buffer solution. A small amount of sample is introduced at one end of the capillary tube, whereafter a high potential difference is applied across the ends of the tube. Electroosmotic flow and differences in electrophoretic mobilities combine to provide a spatial separation of constituents of the sample solution at the outlet end of the capillary tube.

Electroosmotic flow is the movement of a liquid relative to a stationary charge surface as a result of electrical fields applied to the liquid U.S. Pat. No. 4,936,974 to Rose et al. explains electroosmotic flow as a result of charge accumulation at the interior capillary surface due to preferential adsorption of anions from the buffer solution that fills the bore of the capillary tube. The negative charge of the anions attracts a thin layer of mobile positively charged buffer ions which then accumulate adjacent to the inner surface. The charge accumulation at the interior wall provides a radially extending electrical field. The potential across this radially extending electrical field is referred to as the "zeta potential." The longitudinally extending electrical field that is applied across the capillary tube attracts the positive ions which are hydrated by water toward a grounded outlet end of the capillary tube, viscously dragging other hydrated molecules. This dragging of molecules applies to neutral and negatively charged molecules, as well as positively charged molecules. The result is a bulk flow of the sample in the buffer solution toward the grounded outlet end of the capillary tube. Consequently, electroosmotic flow provides a means for moving neutral and negatively charged constituents of a sample toward a ground electrode.

Electrophoretic migration is the movement of charged constituents in response to an electrical field applied along the longitudinal axis of the capillary tube. A positively charged molecule will be accelerated through the electroosmotic flow toward the ground electrode. Negatively charged molecules may be repelled by the ground electrode, but the force of the electroosmotic flow overcomes the repulsion and advances the negatively charged molecules.

As a result of the combination of electroosmotic flow and electrophoretic migration for an analysis in which a positive electrode is applied to the inlet end of the capillary tube and a ground electrode is applied to the outlet end, a spatial separation will occur with positively charged constituents exiting first, followed by neutral constituents and then negatively charged constituents. Each constituent of a sample may be identified by detecting the time required for the constituent to travel through the capillary tube. The quantity of the constituent within the sample is determined by the height and/or area of a signal trace on an electropherogram during a period of detection of that constituent.

An "on-column detector" detects migration of sample constituents past a detection area of the capillary tube between the inlet end and the outlet end. Ultraviolet and fluorescence on-column detectors are common. Alternatively, detection can take place after release of the sample from the outlet end, i.e., "off-column detection." For example, U.S. Pat. Nos. 4,705,616 to Andresen et al. and 4,842,701 to Smith et al. describe electrospraying the separated solution from the outlet end for off-column detection by mass spectrometry.

Obtaining an accurate analysis requires that each sample constituent be moved to the detection area. Often, the sample is introduced into the inlet end of the capillary tube by insertion of the inlet end into a sample vial, whereafter the inlet end is inserted into a first buffer vial electrically connected to a high voltage electrode. The outlet end of the capillary tube is inserted into a buffer reservoir vial connected to the ground electrode. Upon initiating the separation procedure, a negatively charged molecule may be drawn into the first buffer vial before electroosmotic flow can take full effect. Thus, these molecules will not be detected, rendering the analysis less accurate. Another problem in obtaining an accurate analysis involves the resolution of constituent detections. If a sample contains a number of constituents having similar electrophoretic mobilities, an analysis may be susceptible to errors in identifying and in quantifying the constituents. Yet another problem involves external factors, such as atmospheric conditions, that may have an effect on the electrophoretic separation.

U.S. patent application Ser. No. 07/754,797 to Young et al. U.S. Pat. No. 5,180,475, to the assignee of the present application and is incorporated herein by reference, describes a system and method for influencing electroosmotic flow and reducing undesired effects of external influences, thereby improving the analytic procedure. The rate of electroosmotic flow is directly proportional to the permittivity of the solution, the longitudinal axial electrical field and the zeta potential and is inversely proportional to the viscosity of the solution. Young et al. teach that the zeta potential can be controlled by providing a uniformly charged coating of electrically conductive material on the outside wall of the capillary tube. The uniformly charged conductive coating reduces the likelihood that an undesired voltage gradient will be created along the outside wall. A controlled field along the outside wall prevents external forces from adversely affecting the internal ionic charge at the interior wall of the capillary tube. The uniformly charged conductive coating may be allowed to float, but preferably is grounded to reduce the likelihood of electrostatic charges on the outside wall of the capillary tube.

Okubo in Japanese Application No. Sho 55-40048 describes use of a transparent conductive coating that is uniformly charged by a power source. The uniform charge on the transparent coating is selectively turned off to compare the movement of sample constituents before and after the switching of the charge. The comparison provides data for determining what is referred to in the application as the actual electrophoresis speed. The particle movement is determined by use of directing laser light through an electrophoresis tube.

An object of the present invention is to provide a method of making a capillary tube that permits increased control of electroosmotic flow in order to improve the electrophoretic analysis.

SUMMARY OF THE INVENTION

The above object has been met by a method of making an electrophoresis capillary tube to include a coating having a high electrical resistivity, thereby permitting a user to achieve a high voltage drop across the exterior of the capillary tube. The resistivity is uniform along the length of the coating so that a generally uniform potential gradient is created by the application of a high voltage to the coating. The externally applied voltage is vectorially coupled to an electrical field along a migration path through the capillary tube so as to provide a desired zeta potential.

Rather than an external coating for a capillary tube having a high conductivity, the present method is to apply an external coating having a high resistivity. In a preferred embodiment, the capillary tube coating includes a polymer and carbon black. A resistive coating solution is formed by homogeneously mixing the carbon black with the polymer in a solvent. The carbon black should have a content by weight that is less than twenty percent relative to the content by weight of the polymer. Preferably, the content of the carbon black is less than ten percent of the content of the polymer and is optimally in the range of seven to eight percent of the content of the polymer.

The solution is then applied to the exterior of the capillary tube. Typically, the resulting resistive coating is a multi-layered coating that is formed by drying the capillary tube prior to each application of a layer. The resistance of the coating is monitored and the coating is increased in thickness until a desired resistance across the capillary tube has been achieved.

A preferred polymer for forming the external coating is polyimide. Polyimide mixes homogeneously with carbon black and also allows the resulting capillary tube to flex. The solvent may be 1-methyl-2-pyrrolidinone. Materials other than carbon black that have a high electrical conductivity and that mix homogeneously with a selected polymer may be used in place of carbon black. One example of an acceptable conductive material is graphite.

One technique for applying the resistive coating is to secure the capillary tube to a fixture which rotates the tube axially. An ohmmeter is connected across the capillary tube. Successive layers are applied until a desired resistance is achieved, as monitored by the ohmmeter. A second technique is to slidably attach leads of an ohmmeter to an extended length of capillary tube, wherein the ohmmeter leads are at a fixed distance. The length of capillary tube is then drawn continuously past a coating applicator. Again, the ohmmeter monitors the resistance across the fixed length.

An advantage of the present invention is that it provides a capillary tube that can be connected to a first high voltage source that creates a conventional potential gradient along the migration path of the tube, but also allows connection of a second high voltage source to the resistive coating to create an external potential gradient. The internal and external electrical fields are vectorially coupled to establish the zeta potential along the interior of the capillary tube. Since the zeta potential is one factor in determining the rate of electroosmotic flow through the capillary tube, the resistive coating can be used to control the electrophoresis process.

BEST MODE FOR CARRYING OUT THE INVENTION

Figure 1:
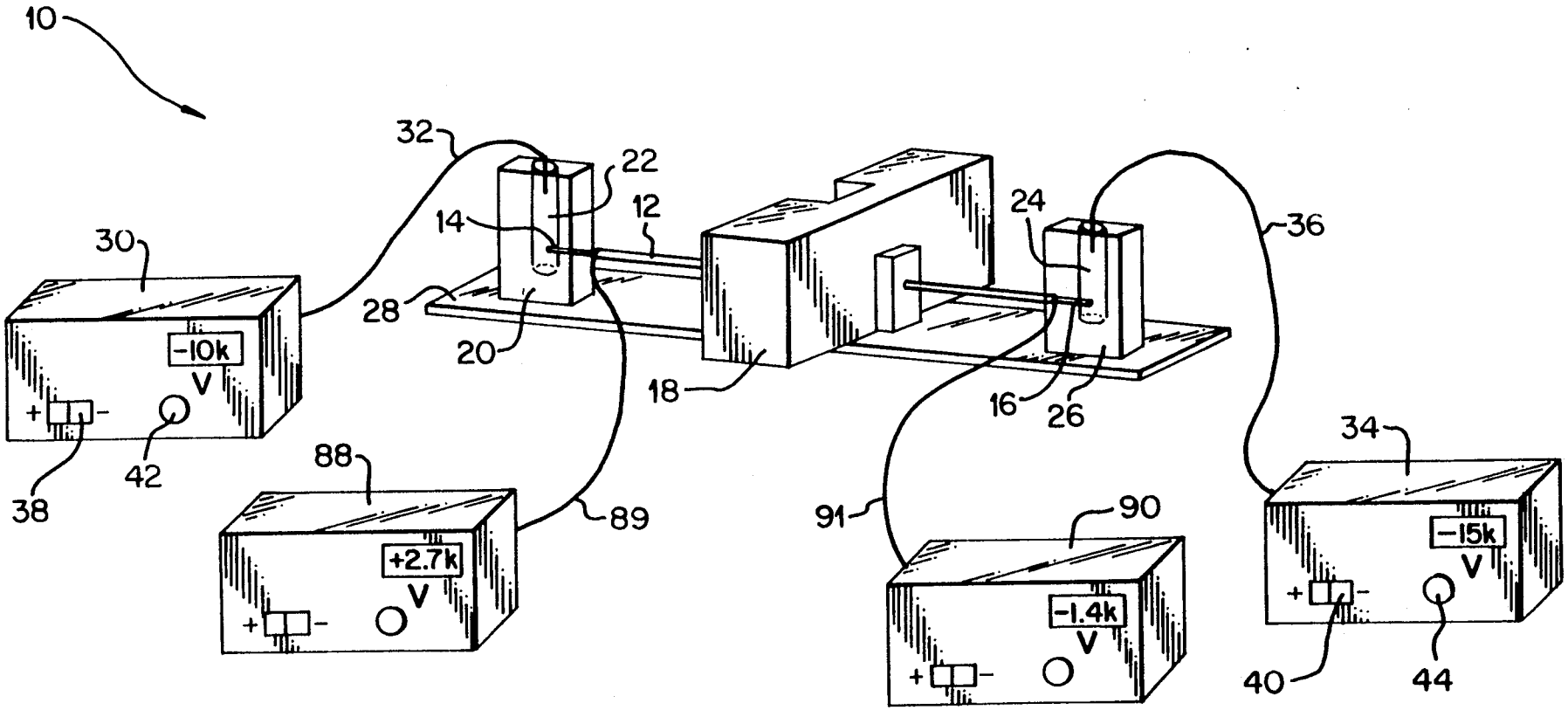
FIG. 1 is a schematic view of an electrophoresis system having on-column detection and having external control structure for affecting the rate of electroosmotic flow through a capillary tube of the system.

With reference to FIG. 1, an electrophoresis system 10 is shown as including a capillary tube 12 having an inlet end 14 and outlet end 16. The capillary tube may have an inside diameter of 50 microns and an outside diameter that is in the range of 140 microns to 360 microns, but these dimensions are not critical.

An on-column detector 18 is located along the length of the capillary tube 12. Any opaque coating on the capillary tube, such as a polyimide coating, is removed from the capillary tube at the optical coupling of the tube to the detector. U.S. Pat. No. 4,940,883 to Karger et al. describes a device for removing a polymer from a portion of a capillary tube to provide a detection window for on-column detection. In capillary zone electrophoresis, ultraviolet absorbance detectors are commonly used, but other detectors are known. For example, monitoring may also be accomplished using a chemi-luminescence, refractive index, or conductivity detector. The optical coupling of the detector to the capillary tube permits detection of movement within the capillary tube.

The inlet end 14 of the capillary tube 12 is inserted into a container 20 having a supply vial 22. At the opposite side of the detector 18 is a buffer reservoir vial 24 that is in fluid communication with the outlet end 16 of the capillary tube. The buffer reservoir vial is housed within a container 26. The two containers 20 and 26 and the detector 18 are shown as resting on a table 28.

A first high voltage power supply 30 is electrically connected to the supply vial 22 via a power line 32 that represents an anode electrode. The first power supply 30 provides a high voltage, shown in FIG. 1 as −10k volts, at the supply vial 22. However, this high voltage is not the potential difference across the capillary tube 12. The potential difference is determined by the voltage at the buffer reservoir vial 24. This voltage is provided by a second high voltage power supply 34 in electrical communication with the buffer reservoir vial 24 via a power line 36 that represents the cathode electrode. The second power supply 34 is illustrated as being set to provide a second high voltage of −15k volts. Thus, the potential difference across the capillary tube 12 is 5k volts. A standard potential gradient in capillary zone electrophoresis is 200v/cm. To achieve this standard, the length of the capillary tube 12 would then be 25cm.

Each of the high voltage power supplies 30 and 34 is a bipolar device having a polarity-select switch 38 and 40 to adjust the polarity of the associated electrode 32 and 36. Voltage-adjustment dials 42 and 44 allow a user to accurately set the outputs of the power supplies. The rate of electroosmotic flow through the capillary tube 12 may be varied while maintaining the same potential gradient by providing corresponding adjustments of the first and second power supplies 30 and 34. That is, a change in the voltage offset relative to ground changes the electroosmotic flow rate and, therefore, the time required to complete an analysis of a particular sample. For example, using the electrophoresis system of FIG. 1 in which the capillary tube has an inside diameter of 50 microns and an outside diameter of 140 microns, with the respective voltages set at −15k volts and −10k volts, a particular analysis requires a migration time of eighty minutes. By varying the voltage offset upwardly relative to ground, the flow rate is increased, so that the same analysis can take place in a much shorter time, e.g., seventeen minutes where each power supply is increased by 15k volts to ground and +5k volts. A corresponding negative adjustment to the two power supplies, i.e. a decrease in the voltage offset relative to ground, decreases the electroosmotic flow rate.

Figure 2:
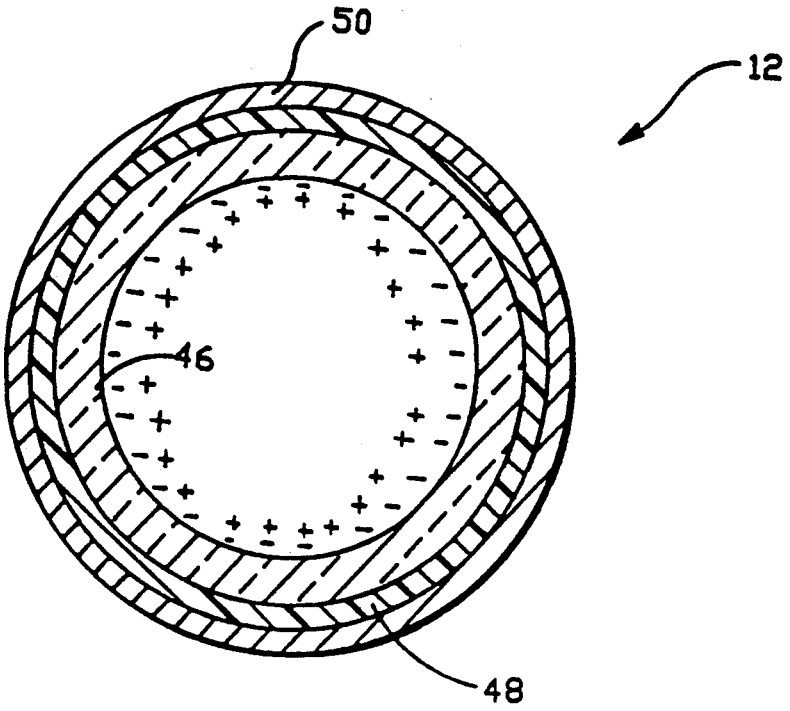
FIG. 2 is a front sectional view of the capillary tube of FIG. 1, wherein the capillary tube includes a resistive coating.

In addition to an adjustment of the voltage offset relative to ground, electroosmotic flow rate can be affected by providing a resistive coating to the capillary tube 12. Referring now to FIG. 2, the capillary tube 12 is shown as including a fused silica capillary layer 46, and a polyimide layer 48. These two layers 46 and 48 are standard in the art. The capillary tube 12 also includes a resistive coating 50. By "resistive coating" what is meant is a conductive coating or layer having a high resistance that may be utilized to establish an electrical field along the capillary tube. Optionally, the layers 48 and 50 may be combined into a single layer to provide a conductive polymer. For example, a cross-linked polyimide containing 7.5 percent carbon black may be used. The thickness of such a coating would determine the bulk resistivity and the sheet resistance of the coating. One practical option would be to provide a coating of a thickness to achieve a bulk resistivity of approximately 2K ohms-cm and a sheet resistance of approximately 2M ohms per square.

The two high voltage power supplies 30 and 34 provide an electrical field along the longitudinal axis of the capillary tube 12. As illustrated by the symbols "+" and "−" in FIG. 2, a radially extending electrical field is also created. A charge accumulation at the interior capillary surface results from preferential adsorption of anions from the buffer solution that fills the migration path of the capillary tube. The negative charge of the anions attracts a thin layer of mobile positively charged buffer ions. The electrical potential is referred to as "zeta potential." Electroosmotic flow is a direct result of this double layer of ions formed on the interior capillary surface. Consequently, any charge at the exterior of the capillary tube has a potential of affecting ion collection and electroosmotic flow.

Returning to FIG. 1, in addition to the first and second high voltage power supplies 30 and 34, there are third and fourth high voltage power supplies 88 and 90. The third high voltage power supply 88 has an electrode lead 89 attached to the resistive coating of the capillary tube 12 at the inlet end 14 of the tube. In like manner, the fourth high voltage power supply 90 has an electrode lead 91 attached to the outlet end 16. The removal of resistive material at the inlet and outlet ends of the capillary tube isolates the high voltage power supplies 88 and 90 from high voltage power supplies 30 and 34.

The first and second high voltage power supplies 30 and 34 create a longitudinal voltage gradient along the axial bore of the capillary tube 12. The third and fourth high voltage power supplies 88 and 90 create a longitudinal voltage gradient along the resistive coating on the capillary tube. The voltage gradient along the resistive coating provides a varying zeta potential at the interior of the capillary tube. This technique vectorially couples the externally applied electrical field with the electrical field along the axial bore of the capillary tube. The electrical potential at the exterior of the capillary tube determines the polarity and the magnitude of the charged double ion layer accumulated at the interior surface of the capillary tube. That is, the potential at the tube exterior determines the zeta potential at a cross section of the tube.

A concern in the electrophoresis system 10 of FIG. 1 is preventing an electrical discharge from the resistive coating of the capillary tube 1 to the on-column detector 18. The system of FIG. 1 suppresses electrical discharge by creating the external voltage gradient along the resistive coating such that the electrical potential at the portion of the coating adjacent to on-column detection is substantially equal to the electrical potential of the on-column detector 18.

Typically, the on-column detector 18 is at ground potential, so that the third and fourth high voltage power supplies 88 and 90 should be set to achieve a ground potential at the detection area of the capillary tube 12. As shown in FIG. 1, the high voltage power supply 88 connected to the inlet end 14 of the capillary tube is set at +2.7k volts. The fourth high voltage power supply 90 establishes a potential of −1.4k volts at the outlet end 16. Since the on-column detection area is conventionally closer to the outlet end 16 than to the inlet end 14, the voltage gradient along the resistive coating will be uniform only if the third high voltage power supply is set at a voltage further from ground than the fourth high voltage power supply.

Figure 3:
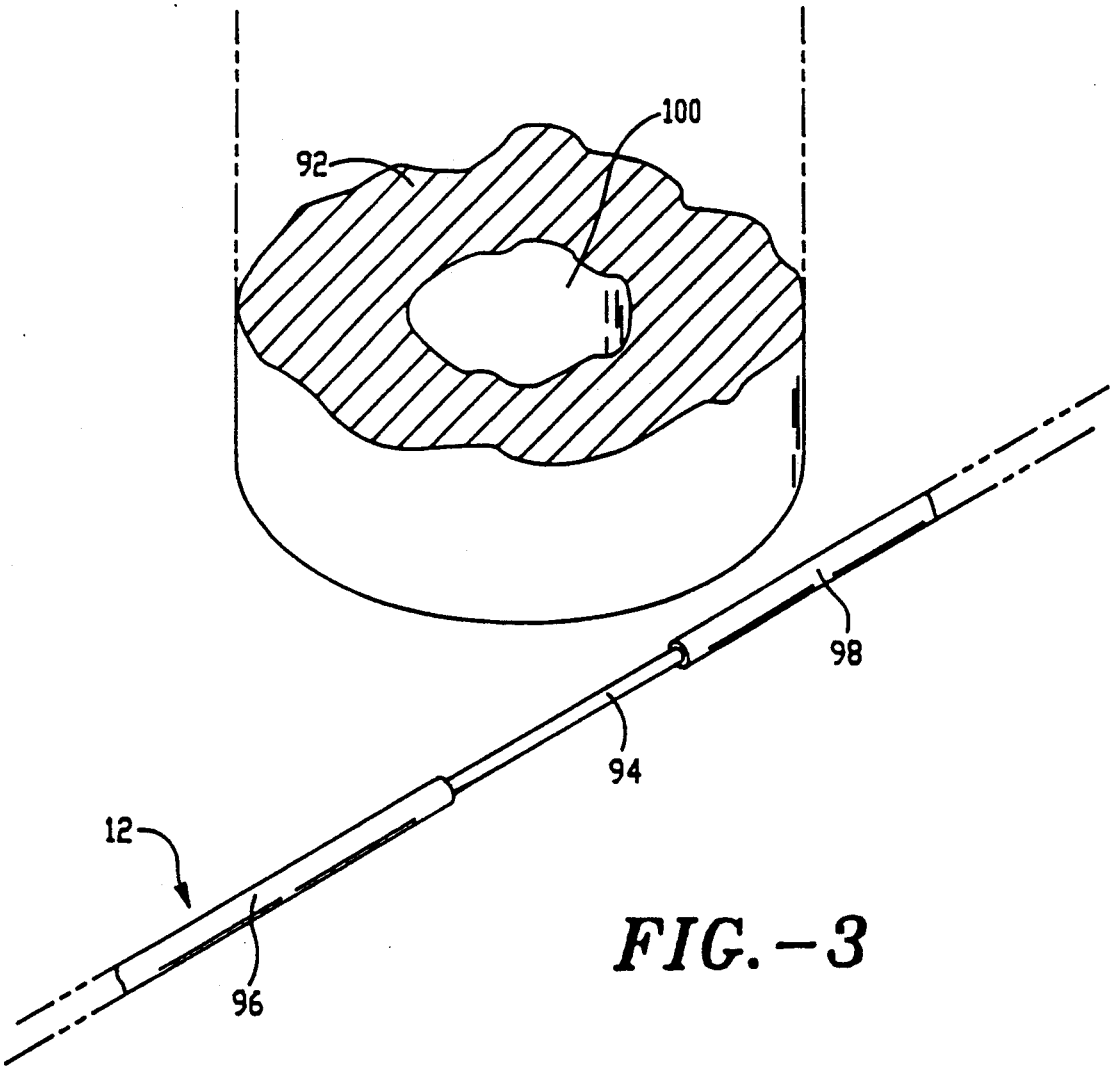
FIG. 3 is a perspective view of the capillary tube and detector of FIG. 1.

Referring now to FIG. 3, a coupling member 92 of the on-column detector is shown. The coupling member is a metallic cylindrically-shaped device having a width greater than an on-column detection window 94 of the capillary tube 12. The coupling member is structured to prevent ambient light from entering the capillary tube. Because the coupling member is metallic, it can be brought into contact with an inlet portion 96 and an outlet portion 98 of the resistive coating on the capillary tube, thereby providing an electrical bridge for linking the two portions. An aperture 100 in the coupling member defines the optical path to the detection window.

Other electrical bridges across the inlet and outlet portions 96 and 98 may be used. Electrical bridges better ensure a continuity of control of electroosmotic flow along the capillary tube 12. Alternatives for providing the electrical bridge include adhering a foil to the resistive coating at opposed sides of the detection window 94, bonding a wire across the detection window outside of the optical path of the on-column detector, and leaving a link of the resistive coating across the detection window during the process of forming the detection window.

In comparison to the capillary tube of FIG. 2, the inlet and outlet portions 96 and 98 in FIG. 3 are applied directly to the fused silica layer of the capillary tube 12. That is, the resistive coating is not separated from the fused silica layer by a polyimide layer. The elimination of the intermediate polyimide layer provides a slight improvement in the control of electroosmotic flow by use of an external electrical field.

Figure 4:
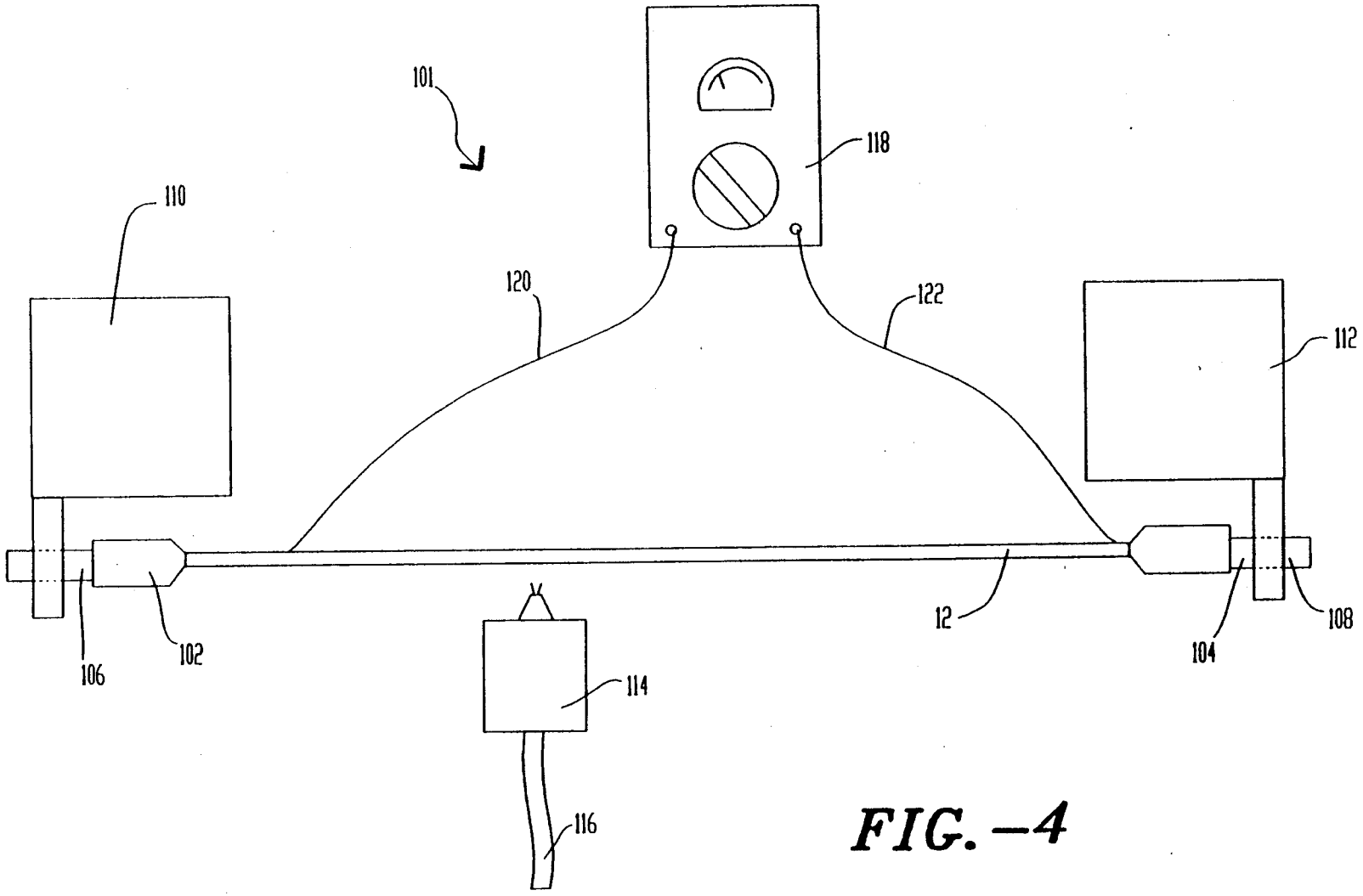
FIG. 4 is a top view of a first embodiment of a system for applying the resistive coating to the capillary tube of FIG. 2.
Figure 5:
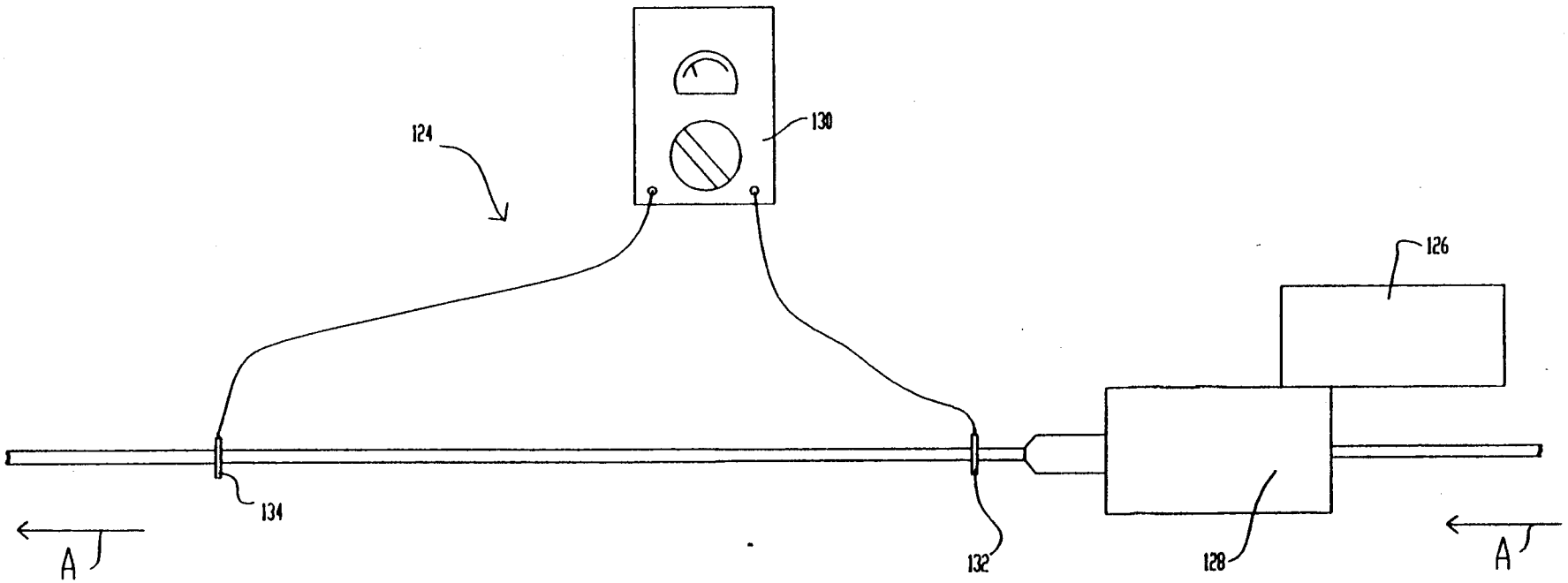
FIG. 5 is a front view of a second embodiment of a system for applying the resistive coating to the capillary tube of FIG. 2.

Referring now to FIG. 4, a first applicator system 101 for making the capillary tube 12 of FIG. 2 is shown. A conventional fused silica tube has opposite ends connected to a pair of grippers 102 and 104. The fused silica tube may already have a layer of polyimide that allows the tube to be flexed during handling. The coating of polyimide is not critical, however. The length of the capillary tube 12 is 25cm.

Extending rearwardly from each gripper 102 and 104 is a rod 106 and 108. Rotational drive motors 110 and 112 rotate the rods. The rotation of the rods is translated to the capillary tube 12 by the grippers 102 and 104. The rotational speed is not critical.

As the capillary tube 12 is rotated, a coating solution is sprayed onto the capillary tube by an applicator 114. A hose 116 supplies a pressurized flow of coating solution to the applicator.

In one experiment, the coating solution was a slurry which comprised 2 grams of polyimide, 150mg of carbon black sold under the trademark CABOT by Mogul L, and 20ml of 1-methyl-2-pyrrolidinone. The three components were mixed in an ultrasonic bath for two hours. A portion of the slurry was then sprayed by an applicator 114 onto a bare fused silica capillary tube 12. The tube was rotated during the spraying. A multi-layer coating was achieved by evaporating the solvent from the coating solution applied to the capillary tube. Evaporation was achieved by use of a flow of hot air from a heat gun, not shown. An ohmmeter 118 attached near opposite ends of the capillary tube 12 by meter leads 120 and 122 was used to monitor the resistance of the coated capillary tube. A second layer of the coating solution was then applied. The steps of drying the capillary tube and applying another layer of the coating solution were repeated until the thickness of the resistive coating was such that the desired resistance along the capillary exterior was achieved, as indicated by the ohmmeter 118.

In the experiment described above, the content by mass, and therefore by weight, was 7.5 percent of the mass and weight of the polyimide. The bulk resistivity was approximately 2K ohms-cm. The resistivity can be adjusted by varying the proportion of the carbon black to the polyimide. Ideally, the content of the carbon black is between 7 percent and 8 percent relative to the content of the polyimide. The content is preferably between 5 percent and 10 percent and is less preferably between 3 percent and 20 percent.

The thickness of the resistive coating on the capillary tube 12 determines the sheet resistance across the exterior coating. As shown in FIG. 1, the resistance must be sufficient to allow a voltage drop of 4.1k volts. The potential gradient along the resistive coating is approximately 200 volts/cm. As noted above, the resistive coating is left off the inlet and outlet ends of the capillary tube, so that the externally applied electrical field does not short to the electrical field applied along the migration path through the capillary tube. Thus, the coated portion of the capillary tube is less than the entire 25cm length of the tube.

A second application system 124 for coating the capillary tube 12 is shown. In this system, the capillary tube is continuously drawn through a drawing tower 126. A slurry, such as the one described above, is contained within a portion 128 of the drawing tower. As the capillary tube moves in the direction of arrows A, the slurry is applied and an ohmmeter 130 monitors the resistance across a fixed length of the capillary tube. Sliding electrical contacts 132 and 134 are connected to the capillary tube. If the electrical resistance across the fixed length between the contacts 132 and 134 is not the desired resistance, the capillary tube is dried and again drawn through the drawing tower to receive a second layer of the resistive coating. This is repeated until the desired resistance has been achieved.

Referring now to FIGS. 1-3, in operation the third and fourth high voltage power supplies 88 and 90 are adjusted to establish a ground adjacent to the point of detection of the capillary tube 12. The first and second high voltage power supplies 30 and 34 are then set to achieve the desired migration of sample constituents within a sample. For a given voltage gradient along the exterior of the capillary tube, as determined by the third and fourth supplies 88 and 90, migration can be varied by corresponding adjustments to the first and second supplies 30 and 34. This is because the zeta potential at the interior of the capillary tube is a vectorial coupling of potentials determined by the four high voltage power supplies. The migration is detected by use of the UV detector 18 along an intermediate portion of the capillary tube.

While the present invention has been illustrated as using separate high voltage power supplies for creating the voltage gradient along the exterior and the interior of the capillary tube, this is not critical. Other known means for establishing desired voltages at appropriate locations along the interior and along the exterior of the capillary tube may be employed. Moreover, on-column detection is not critical to use of the resistive coating.

While perhaps the present invention adapts most easily to use in capillary zone electrophoresis, the invention may be used with other electrophoretic separation techniques in which a capillary tube is employed. For example, the invention may be used with capillary isoelectric focusing which separates sample constituents by isoeleotric point in a pH gradient formed over the length of the capillary. After the separation has been completed, electroosmotic flow may be employed in progressing the separated constituents past an on-column detector. Moreover, while the capillary column has been illustrated as a single capillary tube, the separation capillary may include more than one tube and/or more than one inlet, as in the above-cited U.S. Pat. No. 4,936,974 to Rose et al.

We claim:

1. A method of making a capillary tube for use in separating sample constituents by electroosmotic flow and electrophoretic migration comprising:

providing a capillary action tube having an inlet end and an outlet end and having an axial bore to provide a longitudinal migration path for the flow of sample constituents from the inlet end to the outlet end, forming a resistive coating solution so that a coating having a high electrical resistivity may be achieved, including homogeneously mixing an electrically conductive material with a polymer such that the content by weight of the electrically conductive material is less than twenty percent relative to the content by weight of the polymer, and applying the resistive coating solution to an exterior surface of the capillary action tube, including coating the exterior surface to a thickness to achieve a desired resistance across the coated exterior surface, thereby forming a capillary tube in which electroosmotic flow along the migration path may be influenced by creating a potential gradient along the coated exterior surface in a direction parallel to the migration path.

2. The method of claim 1 wherein the step of forming the resistive coating solution includes selecting carbon black as the electrically conductive material.

3. The method of claim 2 wherein the step of forming the resistive coating solution includes mixing the carbon black with polyimide such that the carbon black has the content of less than ten percent relative to the polyimide.

4. The method of claim 1 wherein the step of forming the resistive coating solution includes mixing a solvent with the electrically conductive material and the polymer, the method further comprising drying the coated exterior surface.

5. The method of claim 4 wherein the step of coating the exterior surface is a step including applying the resistive coating solution a plurality of isolated times, thereby forming a multi-layered coating, the method further comprising monitoring the resistance across the coating to achieve the desired resistance.

6. The method of claim 1 wherein the step of coating the exterior surface includes rotating the capillary action tube axially and includes attaching an ohmmeter across the exterior surface during the step of coating the exterior surface.

7. The method of claim 1 wherein the step of coating the exterior surface includes continuously drawing the capillary action tube past a coating applicator and slidably attaching leads of an ohmmeter, wherein the slidable attachment of the leads provides a fixed distance for monitoring resistivity.

8. The method of claim 1 wherein the step of coating the exterior surface is a step of layering the exterior surface multiple times such that the coating has a desired sheet resistance.

9. The method of claim 1 wherein the step of forming a resistive coating solution is a step of forming a slurry of polyimide, carbon black and 1-methyl-2-pyrrolidinone.

10. A method of making a capillary tube for use in separating sample constituents by electroosmotic flow and electrophoretic migration comprising, forming a glass tube having an axial bore therethrough, and forming a coating having a high electrical resistivity, including the substeps of (1) mixing a slurry having a solvent, a polymer and a content of carbon black, (2) applying the slurry to form a layer that is exterior to the glass tube, and (3) drying the layer.

11. The method of claim 10 wherein the step of forming the coating further includes applying the slurry to form a second layer after the substep of drying has been completed.

12. The method of claim 10 wherein the step of forming the coating includes applying an ohmmeter to the glass tube during the substep of applying the slurry.

13. The method of claim 10 wherein the substep of mixing the slurry includes adding carbon black such that the percentage by weight of carbon black is less than ten percent the percentage by weight of the polymer.

14. The method of claim 10 further comprising forming a polyimide layer on the glass tube prior to the step of forming the coating.

15. The method of claim 14 wherein the step of forming the glass tue is a step of forming a fused silica tube.

16. The method of claim 10 wherein the step of forming the coating further includes the substep of rotating the glass tube during applying the slurry.

17. The method of claim 10 wherein the step of forming the coating further includes the substep of continuously drawing the glass tube past a slurry applicator during applying the slurry.

18. The method of claim 10 wherein mixing the slurry includes mixing a solution comprising greater than eighty percent solvent, greater than nine percent polyimide and less than one percent carbon black.

* * * * *